US005398492A

United States Patent [19]

Thomas

[11] Patent Number: 5,398,492

[45] Date of Patent: Mar. 21, 1995

[54] INDUSTRIAL DUST MOP

[75] Inventor: Manuel A. Thomas, LaGrange, Ga.

[73] Assignee: Milliken Research Corporation, Spartanburg, S.C.

[21] Appl. No.: 46,705

[22] Filed: Apr. 16, 1993

Related U.S. Application Data

[62] Division of Ser. No. 711,322, Jun. 6, 1991, abandoned.

[51] Int. Cl.[6] ..... D02G 3/04; D02G 3/02

[52] U.S. Cl. ..... 57/297; 57/243; 57/252; 57/256; 57/309; 57/400; 57/409; 428/192; 428/193; 428/373; 428/374; 428/375; 15/228; 15/229.1; 15/DIG. 9

[58] Field of Search ..... 156/181, 306; 264/122, 264/322; 57/243, 252, 256, 309, 400, 409; 428/192, 193, 373, 374, 375; 15/228, 229.1, DIG. 9

[56] References Cited

U.S. PATENT DOCUMENTS 3,874,160 4/1975 Kitazawa ..... 57/157
3,949,544 4/1976 Kitazawa ..... 57/157

*Primary Examiner*—Patrick J. Ryan
*Assistant Examiner*—Richard P. Weisberger
*Attorney, Agent, or Firm*—Terry T. Moyer; Earle R. Marden

[57] ABSTRACT

Industrial dust mop having a homogenous yarn composed of high melt staple fibers and low melt staple which has been heated to homogeneously melt the low melt fibers throughout the yarn to form a fused yarn product in the mop.

3 Claims, 1 Drawing Sheet

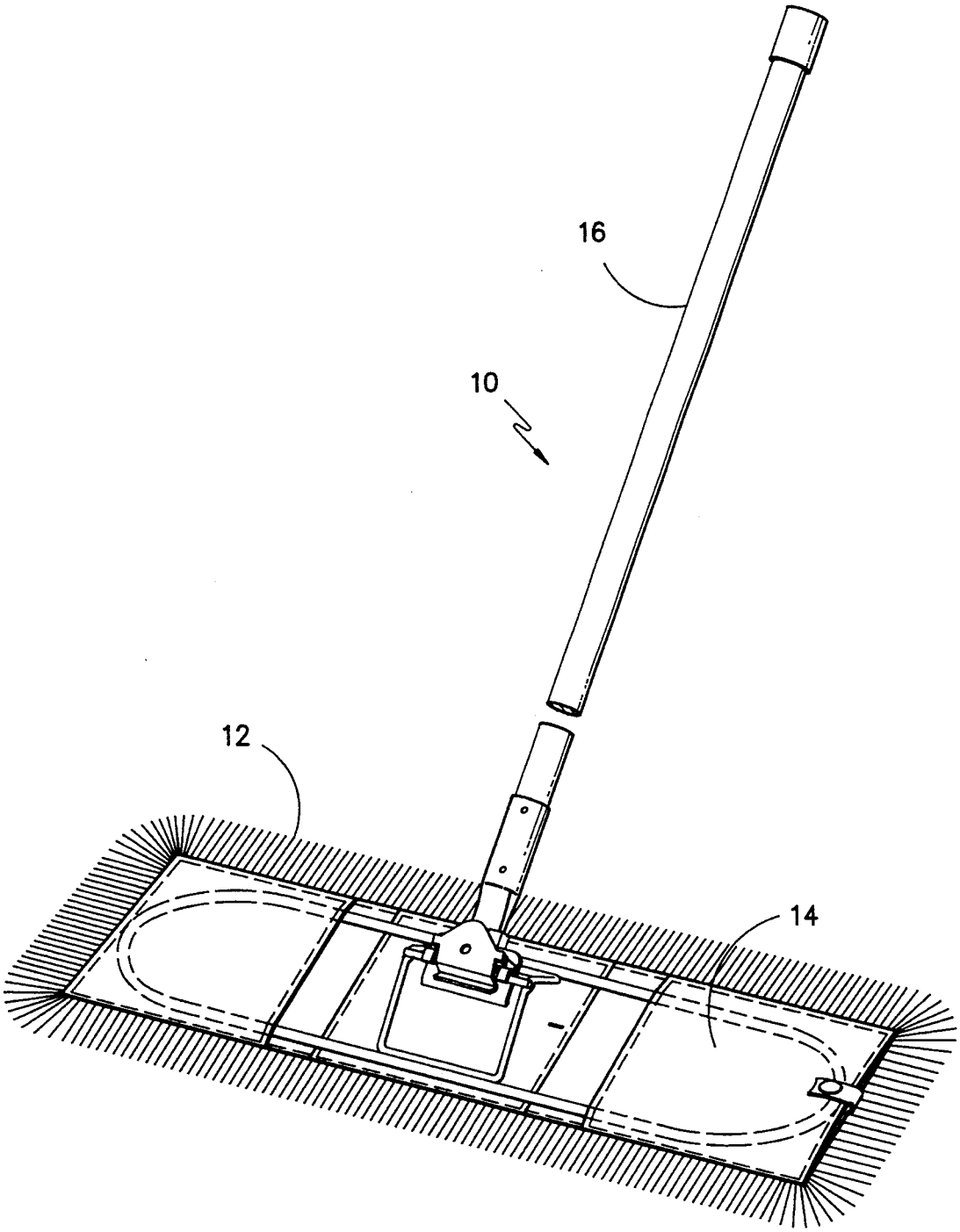
16
10
12
14

INDUSTRIAL DUST MOP

This is a division of application Ser. No. 07/711,322, filed Jun. 6, 1991, now abandoned for IMPROVED INDUSTRIAL DUST MOP.

This invention relates generally to a new and improved industrial dust mop and in particular to an improved industrial dust mop using yarns, containing primarily cotton, which do not tend to come loose or untwist during use and subsequent washing.

BACKGROUND OF THE INVENTION

The mop industry produces a number of different but related products, among them wet mops, dry or dust mops, hand dusters, and carpet and floor machine buffer pads. All have the predominant characteristic of being composed of a plurality of yarns sewn together in some manner to produce the desired shape for the desired job. Except in the case of wet mops, the yarns are generally sewn to a backing, the form of the backing generally characterizing that article for its intended use.

Some procedures use tufting and in other forms of manufacture, a continuous length of pre-sewn fringe is applied to the backing or in the case of a wet mop, a wide length of pre-sewn fringe is utilized and head bands, tail bands and the like applied as desired. The mops may be made with looped or cut ends as desired by the purchaser. Looped end mops, whether they be wet mops or dust mops, are often desired to prevent excessive linting and pulling apart of the fibers during use. This is a particular problem when less expensive yarns are used, such as those yarns formed of particularly coarse and short staple cotton. Advocates of cut end mops assert that cut end yarns have superior dust pick up qualities through the capillary or wicking action of the cut ends. However, users of cut end mops have often had a significant problem with linting.

Manufacturers have heretofore experimented with a variety of materials for forming the yarns. Generally, there is a tendency to use low-cost, coarse, short staple cotton fibers but such fibers excessively lint, are slow to dry when washed, and do not maintain integrity long when used. Other manufacturers have tried synthetic fibers but synthetic fibers are significantly more expensive than cotton and usually have little water absorbency for use as wet mops. Dry mops are often treated with an oil to promote pick-up and retention, the synthetic fibers do not hold the oil and the dry mops do not perform well either. Attempts have been made to produce mops using strands of artificial chamois material but such mops are expensive.

Mops are generally used many times during their useful life and are washed and dried between uses. Drying is a particular problem because pure cotton yarns tend to mat when wet; this forms an impervious top layer which prevents heated air from contacting the full lengths of the yarns and a longer time in the dryer must be spent, ultimately increasing the cost of use.

Other products of the mop industry sometimes include entrance and work area cotton mats which are made with various constructions of yarn and fibers. These too are washed frequently and must maintain integrity for repeated use.

It is therefore an object of the invention to provide a new and improved cotton blend yarn which, when employed to manufacture an industrial dry mop, will not come loose or untwist during use and subsequent washing.

Other objects and advantages of the invention will become clearly apparent as the specification proceeds to describe the invention with reference to the accompanying drawing which shows the new and improved dust mop.

Looking now to the drawing the reference number 10 represents a typical dry mop having a handle 16 and using the new and improved open end spun cotton blend fringe yarn 12 connected to the nylon head band 14 containing more of the yarn in a tufted version underneath. The yarn basically is a blend of staple polyethylene fibers and a blend of poly/cotton staple fibers.

In the preferred form of the invention a sliver consisting of about 12% 6 denier 1¾ staple polyethylene fiber and 88% polyester/cotton staple fibers is delivered to an open end spinning machine to be spun into 2/2 (cotton count) mop yarn. Then the spun yarn is delivered into a heat fusing oven operating at a temperature capable of heating the yarn to 230°–250° F. since the melting point of the polyethylene fiber has a melting point of 230°–250° F. Depending on the efficiency of the oven the yarn remains in the oven for about 30–60 seconds to allow the polyethylene fibers to melt and/or become tacky so that the yarn will be homogeneously fused throughout when allowed to cool. After cooling the fused yarn 12, in any suitable manner, is manufactured into the mop 10.

As indicated, low melt polyethylene fiber is preferred and can vary in the range of 8–16% while the cotton/-synthetic fiber can vary in the range of 92–84%. Other low melt fibers in a temperature range of 230°–250° F. can be employed if lower mop efficiency can be tolerated. Also, blends other than polyester/cotton can be employed as the major fiber components of the yarn 12 so long as the synthetic fiber of the blend melts at a higher temperature than the low melt fiber.

The homogenous blend of low melt staple fibers such as polyethylene with poly/cotton staple fiber when melted and allowed to fuse throughout provides a yarn which basically does blossom out at the cut ends and does not fray thereby increasing the dirt/dust pick-up efficiency and transfers relatively deep within the mop infrastructure. Also as indicated the homogeneously fused yarn does not readily become loose or untwist during use and subsequent washing.

It is understood that the preferred embodiment of the invention has been described and other modifications and changes may be made without departing from the scope of the invention and therefore it is requested that the invention only be limited by the scope of the claims.

I claim:

1. The method of making a homogeneous yarn for the production of mops comprising: blending cotton staple fibers and first synthetic staple fibers, supplying a plurality of low melt staple synthetic fibers having a melting temperature lower than that of the first synthetic staple fiber, blending the first blend with the plurality of low melt staple fibers into a sliver, supplying the sliver to an open end spinning machine to spin the fibers into a yarn, heating the spun yarn at temperatures of about 230°–250° F. for a period of time to melt fibers and allowing the heated yarn to cool to fuse the fibers therein.

2. The method of claim 1 wherein the low melt fibers are staple polyethylene and the yarn is heated for about 30–60 seconds.

3. The method of claim 2 wherein the synthetic fiber is polyester.

* * * * *